US005919318A

United States Patent [19]

Brands et al.

[11] Patent Number: 5,919,318

[45] Date of Patent: Jul. 6, 1999

[54] IRON PHOSPHATING USING SUBSTITUTED MONOCARBOXYLIC ACIDS

[75] Inventors: Karl-Dieter Brands, deceased, late of Aachen, by Thomas Brands, Claudia Brands-Stertenbrink, heirs; Melita Krause; Bernd Mayer, both of Duesseldorf; Thomas Molz, Hilden; Annette Willer, Neuss, all of Germany

[73] Assignee: Henkel Kommanditgesellschaft auf Aktien, Duesseldorf, Germany

[21] Appl. No.: 08/737,662

[22] PCT Filed: May 12, 1995

[86] PCT No.: PCT/EP95/01815

§ 371 Date: Sep. 9, 1997

§ 102(e) Date: Sep. 9, 1997

[87] PCT Pub. No.: WO95/32319

PCT Pub. Date: Nov. 30, 1995

[30] Foreign Application Priority Data

May 21, 1994 [DE] Germany ..... P4417965

[51] Int. Cl.[6] ..... C23C 22/07

[52] U.S. Cl. ..... 148/260; 148/247; 148/253

[58] Field of Search ..... 148/240, 247, 148/248, 252, 253, 260

[56] References Cited

U.S. PATENT DOCUMENTS

| | | | |
|---|---|---|---|
| 2,045,499 | 6/1936 | Tanner et al. | 148/252 |
| 2,657,156 | 7/1953 | Hyams et al. | 148/260 |
| 2,776,917 | 1/1957 | Shnitzler et al. | 148/252 |
| 2,809,906 | 10/1957 | Baecker et al. | 148/6.15 |
| 4,017,335 | 4/1977 | Maloney | 148/6.15 |
| 4,318,754 | 3/1982 | Kosuge et al. | 148/252 |
| 4,680,064 | 7/1987 | Portz et al. | 148/617 |
| 5,137,589 | 8/1992 | Kinkelaar | 148/259 |

FOREIGN PATENT DOCUMENTS

| | | |
|---|---|---|
| 874 944 | 7/1971 | Canada . |
| 154 367 | 9/1985 | European Pat. Off. . |
| 398 203 | 11/1990 | European Pat. Off. . |
| 403 241 | 12/1990 | European Pat. Off. . |
| 1 099 691 | 9/1955 | France . |
| 2 352 069 | 12/1977 | France . |
| 25 06 349 | 8/1976 | Germany . |
| 741 050 | 11/1955 | United Kingdom . |
| 93/09266 | 5/1993 | WIPO . |

*Primary Examiner*—John Sheehan
*Assistant Examiner*—Andrew L. Oltmans
*Attorney, Agent, or Firm*—Ernest G. Szoke; Wayne C. Jaeschke; Norvell E. Wisdom, Jr.

[57] ABSTRACT

Described are a concentrate, a working solution and a process for iron phosphating of metals, in which the solution contains nitrobenzene sulfonic acid and substituted short-chain monocarboxylic acids of the amino acid and/or hydroxycarboxylic acid type as the accelerators.

20 Claims, No Drawings

IRON PHOSPHATING USING SUBSTITUTED MONOCARBOXYLIC ACIDS

FIELD OF THE INVENTION

This invention relates to a new phosphating solution for the so-called "non-coating" phosphating of reactive metal surfaces, more particularly surfaces of steel, aluminum, zinc or alloys of which the main component is at least one of the metals iron, aluminum or zinc. In "non-coating" phosphating, the metal surfaces are treated with acidic solutions (pH range 3.5 to 6) of phosphates which results in the formation on the metal surface of a coating of phosphates and/or oxides of which the cations emanate from the metal surface and not from other components of the phosphating bath. This distinguishes "non-coating" iron phosphating from "coating-forming" zinc phosphating in which the cations of the phosphating bath are incorporated in the phosphate coating. Processes for iron phosphating are known from the prior art. They are used, for example, as a pretreatment before painting in cases where the surfaces in question are not expected to be exposed to significant corrosive influences.

STATEMENT OF RELATED ART

To meet corrosion control requirements, it is desirable that the iron phosphate coatings have a weight per unit area (coating weight) of more than about 0.2 g/m$^2$. In principle, the corrosion-inhibiting effect increases with increasing coating weight. However, with relatively high coating weights, for example above about 0.8 g/m$^2$, the coatings are in danger of becoming powdery and not adhering firmly to the metal surface. This leads to unacceptably poor paint adhesion. Accordingly, efforts have been made to produce iron phosphate coatings which, on the one hand, have a high coating weight, for example of about 0.5 to about 1 g/m$^2$, the coatings at the same time being intended to form firmly adhering coatings.

It is known that coating formation is influenced to a considerable extent by the presence of so-called "accelerators". Accelerators are inorganic or organic substances with an oxidizing effect and, occasionally, with a reducing effect. Inorganic accelerators are, for example, nitrates, chlorates, bromates, molybdates and tungstates. Known organic accelerators are aromatic nitro compounds such as, for example, nitrobenzene sulfonic acid, more particularly m-nitrobenzene sulfonic acid ("NBA"). One example of an inorganic substance with more of a reducing effect and good accelerator properties is hydroxylamine and its salts. Phosphating baths containing such accelerator systems are known, for example, from U.S. Pat. No. 5,137,589 and from WO 93/09266. According to the second of these documents, particularly good coatings are obtained where oxidizing and reducing accelerators are combined with one another, in the present case for example hydroxylamine with organic nitro compounds, with molybdates or tungstates.

Relatively thin coatings (0.2 to 0.5 g/m$^2$), generally with a bluish iridescence, are obtained when a molybdate accelerator is used. With organic accelerators, it is possible to obtain thicker coatings up to 1 g/m$^2$ which generally afford significantly better protection against corrosion in the form of creeping rust. Phosphate coatings with a weight of more than 0.5 g/m$^2$ are produced by thick-coating iron phosphating while phosphate coatings with a weight of less than 0.5 g/m$^2$ are produced by thin-coating iron phosphating.

It is also known that the formation of iron phosphate coatings is favorably influenced by the presence in the phosphating solution of chelating complexing agents for iron. According to U.S. Pat. No. 5,137,589, gluconic acid is particularly suitable for this purpose. In addition, CA 874,944 recommends the use of ethylenediamine tetraacetic acid, nitrilotriacetic acid, diethylenetriamine pentaacetic acid, citric acid, tartaric acid and glucoheptonic acid. One feature common to the complexing agents mentioned is that they represent chelating carboxylic acids containing at least 4 carbon atoms and at least 3 substituents selected from carboxyl and hydroxy groups.

One of the requirements modern iron phosphating baths are expected to satisfy is that they should be capable of treating not only iron surfaces, but also surfaces of zinc, aluminum and their alloys. Although no phosphate coatings or, at most, very thin phosphate coatings are formed on aluminum and zinc, paint adhesion is somewhat improved by the etching effect of the acid. A disadvantage of this so-called "mixed" method of operation lies in the influence of the aluminum ions passing into solution which, even in very low concentrations, disrupt formation of the iron phosphate coating. This "bath poison" can be complexed and hence rendered harmless by the addition of fluorides to the phosphating baths. The addition of fluorides also improves the pickling effect on aluminum surfaces. It has been found to be favorable in this regard for the treatment solutions to contain free and/or complexed fluoride (WO 93/09266).

According to EP-A-398 203, iron phosphating solutions contain anionic titanium compounds instead of the usual accelerators, preferably in a concentration of 0.05 to 0.2 g/l of dissolved titanium.

In iron phosphating, the metal parts may first be cleaned in a cleaning solution and then treated in a phosphating bath. In this case, the phosphating bath itself is not required to have a cleaning effect. Although this procedure provides better cleaning and phosphating results, it does require a larger number of treatment baths. Alternatively, soiled metal parts may be simultaneously cleaned and phosphated in one and the same bath. In this case, surfactants, preferably nonionic surfactants, have to be added to the phosphating bath. According to WO 93/09266, ethoxylated alcohols containing 12 to 22 carbon atoms, other modified aromatic or aliphatic polyethers and salts of complex organic phosphoric acid esters, for example, are suitable for this purpose.

DESCRIPTION OF THE INVENTION

Object of the Invention

The problem addressed by the present invention was to provide an iron phosphating solution containing an ecologically safe accelerator system. It has been found in this regard that ecologically safe substituted monocarboxylic acids in conjunction with the co-accelerator nitrobenzene sulfonic acid lead to phosphate coatings which satisfy technical requirements.

SUMMARY OF THE INVENTION

Accordingly, the present invention relates to an aqueous solution for phosphating metals that has a pH value of 3.5 to 6 and contains:

a) from 1 to 20 g/l of dissolved phosphate, b) from 0.02 to 2 g/l of nitrobenzene sulfonic acid, c) water and, if desired, other auxiliaries, characterized in that the solution additionally contains:

d) 0.01 to 2 g/l of one or more organic monocarboxylic acids corresponding to general formula (I):

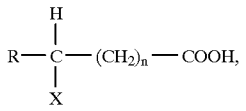

(I)

in which:

R=H, $CH_3$, $CH_2Y$, $C_2H_5$, $C_2H_4Y$, $C_6H_5$, $C_6H_4Y$ or $C_6H_3Y_2$,

X and Y independently of one another represent $NH_2$ or OH and n=0, 1 or 2.

DETAILED DESCRIPTION OF THE INVENTION, INCLUDING PREFERRED EMBODIMENTS

Depending on the choice of the substituent X, formula (I) above describes either amino acids (X=$NH_2$) or hydroxycarboxylic acids (X=OH). Among the amino acids, α-amino acids are preferred. They are described by general formula (I) in the version where the subscript n=0. The amino acids are preferably selected from glycine, alanine, serine, phenyl alanine, (hydroxyphenyl) alanine and (dihydroxyphenyl) alanine, glycine, alanine and serine being particularly preferred.

The hydroxycarboxylic acids of general formula (I) characterized by X=OH are preferably selected from glycolic acid and lactic acid.

Phosphating solutions containing 0.1 to 0.8 g/l and preferably 0.2 to 0.4 g/l of one or more carboxylic acids corresponding to general formula (I) are preferably used.

Particularly favorable phosphating results are obtained with phosphating solutions containing 0.2 to 0.5 g/l of nitrobenzene sulfonic acid. m-Nitrobenzene sulfonic acid ("NBA") is preferably used.

In general, the substituted carboxylic acids described by general formula (I) are optically active. For their use in accordance with the invention, it does not matter whether the acids are present in the racemate form or in the R- or L-form.

The acids mentioned, including the phosphoric acid, may be used either as such or in the form of their alkali metal or ammonium salts. The pH value of the phosphating solution has to be adjusted to the effective range of about 3.5 to about 6.0. This may optionally be done by addition of an acid, preferably phosphoric acid, or an alkali, preferably sodium hydroxide. Under these pH conditions, the acids mentioned are partly present in non-dissociated form according to their respective pK values.

The phosphating solution according to the invention may contain other auxiliaries known from the prior art. Examples of such auxiliaries are:

e) 0.05 to 3 g/l of free and/or complexed fluoride. According to WO 93/09266, it is advisable for the solution to contain both free and complexed fluoride. Suitable sources for free fluoride are, for example, hydrofluoric acid and alkali metal and/or ammonium fluorides while suitable sources for complexed fluoride are, for example, tetrafluoroborates, hexafluorotitanates, hexafluorozirconates, hexafluorosilicates or their acids.

f) 0.1 to 6 g/l of a chelating carboxylic acid containing at least 4 carbon atoms and at least 3 substituents selected from carboxyl and hydroxy groups. Examples of such chelating carboxylic acids are sugar acids, such as gluconic acid, polybasic hydroxycarboxylic acids, such as tartaric acid and citric acid, and carboxylic acids derived from tertiary amines, such as ethylenediamine tetraacetic acid, diethylenetriamine pentaacetic acid or nitrilotriacetic acid. Gluconic acid is particularly preferred.

g) 0.02 to 20 mmoles/l of molybdate and/or tungstate. In the most simple case, salts of molybdic acid $H_2MoO_4$ and/or tungstic acid $H_2WO_4$ may be used. However, the tungsten- or molybdenum-containing anions may also be present in condensed form and, in the case of molybdenum for example, may be described by the general formula $[Mo_nO_{(3n+1)}]^{2-}$.

h) 0.02 to 1 g/l of an anionic titanium compound according to the teaching of EP-A-398 203 and/or a corresponding quantity of an anionic zirconium compound, based on the quantity of anions. Hexafluorotitanic acid, hexafluorozirconic acid or alkali metal or ammonium ions thereof are particularly suitable for this purpose. The concentrations of the anions are preferably in the range from 0.05 to 0.5 g/l.

i) Up to 40 g/l, preferably 0.2 to 1 g/l and more preferably 0.3 to 0.5 g/l of surfactants, preferably nonionic surfactants of the fatty alcohol ethoxylate type. Such surfactants are necessary in particular when the phosphating solution is also intended to have a cleaning effect. Depending on the foaming tendency of the surfactants, which should preferably be as low as possible, it may be necessary to use defoaming substances, for example block copolymers of ethylene oxide and propylene oxide, together with the surfactants. In addition, it may be necessary, particularly with relatively high surfactant contents, to use so-called hydrotropes for formulating homogeneous concentrates of the treatment solutions. Suitable hydrotropes are, for example, toluene, xylene or cumene sulfonates, the hydrotropic effect of which can be supported by addition of water-soluble, complex organic phosphoric acid esters.

k) 0.05 to 5 g/l of nitrate.

After working in, the iron phosphating baths normally have iron(II) contents of up to about 25 ppm which positively influence the properties of the baths. In the preparation of fresh phosphating solutions, it is advisable to add iron(II) ions in the ppm range, for example by addition of around 20 to 50 ppm of iron(II) sulfate.

Phosphating solutions are additionally characterized by their "total acid" content expressed in points. The total acid points count is understood to be the consumption in milliliters of 0.1N sodium hydroxide for titrating 10 ml of the solution to the end point of phenolphthalein or to a pH value of 8.5. In practice, typical total acid ranges are between about 3 and about 7 points and preferably between about 4 and about 6 points.

The temperatures of the treatment solutions are normally between about 30 and 70° C. In the case of cleaning baths in particular, the bath temperature is determined by the type and quantity of soil and also by the intended treatment time. The minimum temperature depends upon the foaming behavior of the wetting agents used and is preferably selected above the cloud point of the wetting agents. The temperature is generally between 50 and 60° C. The workpieces to be treated may be sprayed with or immersed in the solution. Higher coating weights are generally obtained with immersion processes. Depending on the method of application and on the substrate, the necessary treatment times can be between 15 seconds and 10 minutes, although in practice the treatment times are rarely less than 60 seconds and rarely more than 5 minutes.

Accordingly, the present invention also relates to a process for phosphating metal surfaces, preferably surfaces of steel, zinc, aluminum or alloys of which the main component is at least one of the metals iron, zinc or aluminum, characterized in that the surfaces are contacted with the solutions described above, preferably with a temperature of 30 to 70° C., for between 15 seconds and 10 minutes and preferably for 1 to 5 minutes by immersion in and/or spraying with the solution. The process parameters are preferably selected so that phosphate coatings with a coating weight of 0.2 to 1 g/m$^2$, preferably 0.4 to 0.9 g/m$^2$ and more preferably 0.4 to 0.7 g/m$^2$ are obtained. The process may be used in particular for pretreating metal surfaces before the application of an organic coating, preferably selected from the group of paints and lacquers and natural or synthetic rubbers.

The ready-to-use phosphating solutions may be prepared by dissolving the individual components in the necessary concentration in water in situ. However, the normal procedure is to prepare concentrates of the phosphating solutions which are diluted in situ to the necessary in-use concentration. Aqueous concentrates are normally prepared in such a way that the in-use concentration can be achieved by dilution with water by a factor of 5 to 200 and preferably 20 to 100. Accordingly, the present invention also relates to aqueous concentrates from which the phosphating solutions described above can be obtained by corresponding dilution with water.

Powder-form concentrates may be used as an alternative to liquid aqueous concentrates. Their composition is selected so that the phosphating solutions described above are obtained by dissolving the powder in water in a concentration of 0.2 to 5% by weight and preferably 0.5 to 3% by weight.

Iron phosphating baths can be controlled and regulated on the basis of their pH value, their electrical conductivity or the total acid points number.

To increase their corrosion-inhibiting effect, iron phosphate coatings may be subjected to a passivating aftertreatment. Chromium-containing and chromium-free passivating agents are available for this purpose. A prerequisite for high-quality lacquer coatings is the thorough rinsing of the phosphated parts, whether or not they have been passivated. To this end, the parts are rinsed once or twice with process water and, finally, with deionized water.

EXAMPLES

To test the phosphating baths, steel plates (St 1405) were subjected to the following process steps:

1. Alkaline cleaning (spraying)
   Ridoline® 1250 E (Henkel KGaA), 70° C., 2 mins. 1 bar, 20 g/l
2. Rinsing
3. Iron phosphating (spraying)
   50° C., 2.5 mins. 1 bar
   Bath composition: see individual Examples
4. Rinsing
5. Rinsing, deionized water
6. Drying
7. For corrosion testing: powder coating with powder lacquer (Herberts PE/EP 400) cured for 10 minutes at 180° C.

Coating weights were determined by dissolving the phosphate coating with triethanolamine in accordance with DIN [an abbreviation meaning "German Industrial Standard"] 50942. Corrosion resistance was tested by three-weeks' salt spray testing in accordance with DIN 53167. The creepage of rust under the lacquer at a cut was measured after a test duration of 21 days.

Examples 1 to 6, Comparison Examples 1 to 3

The phosphating baths had the following composition:

0.79% $H_3PO_4$, 85%

0.38% NaOH, 50%

0.014% Na gluconate 0.005% $FeSO_4.7H_2O$ accelerator according to Table 1

After addition of the accelerator, the pH was adjusted to the value indicated in Table 1 with 50% sodium hydroxide solution.

Examples 7 to 10

The phosphating baths had the following composition:

400 ppm m-nitrobenzene sulfonic acid 240 ppm lactic acid 125 ppm gluconic acid 10 ppm iron(II)

phosphoric acid, sodium hydroxide: Table 2; pH: 4.5.

Examples 11 to 14, Comparison Examples 4 to 6

The phosphating baths had the following composition:

0.5% phosphoric acid, 75%

0.02% gluconic acid, 50%

0.1% Na cumene sulfonate 0.1% P3-Tensopon® 0555 (nonionic surfactant mixture based on fatty alcohol ethoxylate propoxylate, 30% aqueous solution; Henkel KGaA, Düsseldorf)

0.005% $FeSO_4.7H_2O$ accelerator according to Table 3 adjusted to pH 5.0 with 50% sodium hydroxide solution.

The steel plates were lacquered and tested in the same way as in Examples 1 to 3. The lacquer thickness was around 50 μm. The results are set out in Table 3.

TABLE 1

QUANTITY VARIATION OF THE ACCELERATOR SYSTEM NBA[1)]/LACTIC ACID

| Test No. | ppm of NBA[1)] in the Bath | ppm of Lactic Acid in the Bath | pH | TA[2)] | Coating Weight, g/m$^2$ | Appearance | Lacquer Thickness (μ) | Creepage Under Lacquer (mm) |
|---|---|---|---|---|---|---|---|---|
| Comp. 1 | — | — | 4.5 | 5.3 | 0.22 | Gray | | |
| Comp. 2 | 300 | — | 4.5 | 5.3 | 1.0 | Powdery | | |

TABLE 1-continued

QUANTITY VARIATION OF THE ACCELERATOR SYSTEM NBA[1)]/LACTIC ACID

| Test No. | ppm of NBA[1)] in the Bath | ppm of Lactic Acid in the Bath | pH | TA[2)] | Coating Weight, g/m$^2$ | Appearance | Lacquer Thickness ($\mu$) | Creepage Under Lacquer (mm) |
|---|---|---|---|---|---|---|---|---|
| Comp. 3 | — | 300 | 4.5 | 5.3 | 0.18 | Gray | | |
| Example 1 | 500 | 300 | 4.5 | 5.3 | 0.67 | Bluish | 48 | 3.9 |
| Example 2 | 400 | 240 | 4.5 | 3.1 | 0.77 | Bluish | 52 | 4.5 |
| Example 3 | 300 | 240 | 4.5 | 3.1 | 0.86 | Bluish | 45 | 5.1 |
| Example 4 | 300 | 180 | 4.5 | 3.1 | 0.68 | Bluish | | |
| Example 5 | 200 | 960 | 4.5 | 5.3 | 0.52 | Slightly powdery | | |
| Example 6 | 400 | 960 | 4.5 | 3.2 | 1.17 | Powdery | | |

[1)]NBA = m-Nitrobenzene sulfonic acid
[2)]TA = Total acid (points)

TABLE 2

VARIATION OF PHOSPHATE AND TOTAL ACID

| Test No. | $H_3PO_4$, 85%, g/l | NaOH, 50%, g/l | TA | Coating Weight, g/m$^2$ | Appearance |
|---|---|---|---|---|---|
| Example 7 | 4.6 | 2.2 | 2.5 | 0.77 | Grey-blue, firm |
| Example 8 | 7.9 | 3.8 | 3.7 | 0.84 | Iridescent bluish, firm |
| Example 9 | 6.2 | 3.0 | 4.2 | 0.84 | Iridescent bluish, firm |
| Example 10 | 9.3 | 4.47 | 7.2 | 0.59 | Grey, readily wiped off |

TABLE 3

ACCELERATORS AND PHOSPHATING RESULTS

| Test No. | Accelerator | Coating Weight g/m$^2$ | Creepage Under Paint, mm |
|---|---|---|---|
| Comp. 4 | 300 ppm NBA<br>200 ppm Hydroxylamine | 0.64 | 2.1 |
| Comp. 5 | 300 ppm NBA | 0.61 | 5.5 |
| Comp. 6 | 400 ppm NBA | 0.64 | 6.5 |
| Example 11 | 300 ppm NBA<br>300 ppm Glycine | 0.56 | 2.1 |
| Example 12 | 400 NBA<br>200 ppm Glycine | 0.58 | 1.7 |
| Example 13 | 300 ppm NBA<br>200 ppm Lactic acid | 0.56 | 1.9 |
| Example 14 | 300 ppm NBA<br>300 ppm Lactic acid | 0.58 | 1.7 |

The invention claimed is:

1. An aqueous solution for iron phosphating of metals, said solution having a pH value of 3.5 to 6 and comprising:

a) from 1 to 20 g/l of dissolved phosphate, b) from 0.02 to 2 g/l of nitrobenzene sulfonic acid, c) water, and d) from 0.01 to 0.8 g/l of one or more organic monocarboxylic acids corresponding to general formula (I):

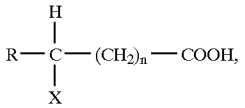

(I)

in which:

R=H, $CH_3$, $CH_2Y$, $C_2H_5$, $C_2H_4Y$, $C_6H_5$, $C_6H_4Y$ or $C_6H_3Y_2$:

X and Y independently of one another represent $NH_2$ or OH; and n=0, 1 or 2.

2. A phosphating solution as claimed in claim 1, wherein, in general formula (I), n=0 and X=$NH_2$.

3. A phosphating solution as claimed in claim 1, wherein, in general formula (I), X=0H.

4. A phosphating solution as claimed in claim 3, which contains from 0.1 to 0.8 g/l of one or more carboxylic acids corresponding to general formula (I).

5. A phosphating solution as claimed in claim 4, which contains from 0.2 to 0.5 g/l of nitrobenzene sulfonic acid.

6. A phosphating solution as claimed in claim 5, which contains m-nitrobenzene sulfonic acid as the nitrobenzene sulfonic acid.

7. A phosphating solution as claimed in claim 6, which additionally comprises one or more of the following auxiliaries:

e) from 0.05 to 3 g/l of free fluoride, complexed fluoride, or both, f) from 0.1 to 6 g/l of a chelating carboxylic acid containing at least 4 carbon atoms and at least 3 substituents selected from carboxyl and hydroxy groups, g) from 0.02 to 20 mmoles/l of molybdate, tungstate, or both, h) from 0.05 to 0.2 g/l of an anionic titanium compound, i) up to 40 g/l of surfactants, and k) from 0.05 to 5 g/l of nitrate.

8. A process for iron phosphating of metal surfaces selected from the group consisting of surfaces of steel, zinc, aluminum and alloys of which the main component is at least one of the metals iron, zinc or aluminum, wherein the surfaces are contacted with solutions according to claim 1 at a temperature of 30 to 70° C. for between 15 seconds and 10 minutes by immersion in, spraying with, or both immersion in and spraying with the solution.

9. A process as claimed in claim 8, characterized in that phosphate coatings are produced with a coating weight of 0.2 to 1 g/m$^2$.

10. A process as claimed in claim 8 for pretreating metal surfaces before the application of an organic coating.

11. An aqueous concentrate which, by dilution with water by a factor of 5 to 200, forms an iron phosphating solution comprising:

a) from 1 to 20 g/l of dissolved phosphate, b) from 0.02 to 2 g/l of nitrobenzene sulfonic acid, c) water, and d) from 0.01 to 0.8 g/l of one or more organic monocarboxylic acids corresponding to general formula (I):

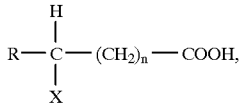

(I)

in which:

R=H, $CH_3$, $CH_2Y$, $C_2H_5$, $C_2H_4Y$, $C_6H_5$, $C_6H_4Y$ or $C_6H_3Y_2$;

X and Y independently of one another represent $NH_2$ or OH; and n=0, 1 or 2.

12. A powder which, by dissolution in water in a concentration of 0.2 to 5% by weight, forms an iron phosphating solution comprising:

a) from 1 to 20 g/l of dissolved phosphate, b) from 0.02 to 2 g/l of nitrobenzene sulfonic acid c) water, and d) from 0.01 to 0.8 g/l of one or more organic monocarboxylic acids corresponding to general formula (I):

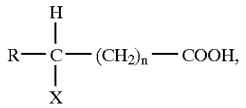

(I)

in which:

R=H, $CH_3$, $CH_2Y$, $C_2H_5$, $C_2H_4Y$, $C_6H_5$, $C_6H_4Y$ or $C_6H_3Y_2$;

X and Y independently of one another represents $NH_2$ or OH; and n=0, 1 or 2.

13. A phosphating solution as claimed in claim 2 which contains from 0.1 to 0.8 g/l of one or more carboxylic acids corresponding to general formula (I).

14. A phosphating solution as claimed in claim 1, which contains from 0.1 to 0.8 g/l of one or more carboxylic acids corresponding to general formula (I).

15. A phosphating solution as claimed in claim 1, which contains from 0.2 to 0.5 g/l of nitrobenzene sulfonic acid.

16. A phosphating solution as claimed in claim 1, which contains m-nitrobenzene sulfonic acid as the nitrobenzene sulfonic acid.

17. A phosphating solution as claimed in claim 16, which additionally comprises one or more of the following auxiliaries:

e) from 0.05 to 3 g/l of free fluoride, complexed fluoride, or both, f) from 0.1 to 6 g/l of a chelating carboxylic acid containing at least 4 carbon atoms and at least 3 substituents selected from carboxyl and hydroxy groups, g) from 0.02 to 20 mmoles/l of molybdate, tungstate, or both, h) from 0.05 to 0.2 g/l of an anionic titanium compound, i) up to 40 g/l of surfactants, and k) from 0.05 to 5 g/l of nitrate.

18. A phosphating solution as claimed in claim 15, which additionally comprises one or more of the following auxiliaries:

e) from 0.05 to 3 g/l of free fluoride, complexed fluoride, or both, f) from 0.1 to 6 g/l of a chelating carboxylic acid containing at least 4 carbon atoms and at least 3 substituents selected from carboxyl and hydroxy groups, g) from 0.02 to 20 mmoles/l of molybdate, tungstate, or both, h) from 0.05 to 0.2 g/l of an anionic titanium compound, i) up to 40 g/l of surfactants, and k) from 0.05 to 5 g/l of nitrate.

19. A phosphating solution as claimed in claim 14, which additionally comprises one or more of the following auxiliaries:

e) from 0.05 to 3 g/l of free fluoride, complexed fluoride, or both, f) from 0.1 to 6 g/l of a chelating carboxylic acid containing at least 4 carbon atoms and at least 3 substituents selected from carboxyl and hydroxy groups, g) from 0.02 to 20 mmoles/l of molybdate, tungstate, or both, h) from 0.05 to 0.2 g/l of an anionic titanium compound, i) up to 40 g/l of surfactants, and k) from 0.05 to 5 g/l of nitrate.

20. A phosphating solution as claimed in claim 1, which additionally comprises one or more of the following auxiliaries:

e) from 0.05 to 3 g/l of free fluoride, complexed fluoride, or both, f) from 0.1 to 6 g/l of a chelating carboxylic acid containing at least 4 carbon atoms and at least 3 substituents selected from carboxyl and hydroxy groups, g) from 0.02 to 20 mmoles/l of molybdate, tungstate, or both, h) from 0.05 to 0.2 g/l of an anionic titanium compound, i) up to 40 g/l of surfactants, and k) from 0.05 to 5 g/l of nitrate.

* * * * *